US006986270B2

(12) United States Patent
Miller, III et al.

(10) Patent No.: US 6,986,270 B2
(45) Date of Patent: Jan. 17, 2006

(54) KNITTED FABRIC CONSTRUCTION WITH IMPROVED MOISTURE MANAGEMENT

(75) Inventors: Robert A. Miller, III, New Ringgold, PA (US); Jill B. Cravotta, Bethel, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 341 days.

(21) Appl. No.: 10/377,433

(22) Filed: Feb. 28, 2003

(65) Prior Publication Data

US 2004/0171324 A1 Sep. 2, 2004

(51) Int. Cl.
*D04B 11/26* (2006.01)

(52) U.S. Cl. ..... 66/202; 66/171; 442/308

(58) Field of Classification Search ..... 66/202, 66/169 R, 170, 171, 177, 190, 191, 196, 66/198, 200; 2/400–409; 450/102–105; 442/304, 308–310

See application file for complete search history.

(56) References Cited

U.S. PATENT DOCUMENTS

| | | | | |
|---|---|---|---|---|
| 3,224,231 A | | 12/1965 | Matz | 66/171 |
| 3,561,441 A | * | 2/1971 | Lombardi | 66/194 |
| 4,369,828 A | | 1/1983 | Tatro | 160/107 |
| 4,412,433 A | | 11/1983 | Safrit et al. | 66/177 |
| 4,494,388 A | | 1/1985 | Lau et al. | 66/178 A |
| 4,522,044 A | | 6/1985 | Lineberry et al. | 66/185 |
| 4,530,873 A | | 7/1985 | Okada | 428/253 |
| 4,732,015 A | * | 3/1988 | Abrams et al. | 66/172 E |
| 5,038,414 A | | 8/1991 | Freeman | 2/409 |
| 5,050,406 A | | 9/1991 | Strauss et al. | 66/177 |
| 5,416,929 A | * | 5/1995 | Braunstein | 2/406 |
| 5,547,733 A | | 8/1996 | Rock et al. | 428/91 |
| 6,041,446 A | * | 3/2000 | Braunstein et al. | 2/400 |
| 6,341,505 B1 | | 1/2002 | Dahlgren | 66/185 |
| 6,381,994 B1 | | 5/2002 | Lee | 66/196 |
| 6,427,493 B1 | | 8/2002 | Kasdan et al. | 66/169 R |

FOREIGN PATENT DOCUMENTS

FR 70 18167 12/1971

OTHER PUBLICATIONS

International Search Report (PCT /US2004/005807, dated Sep. 2, 2004).

* cited by examiner

*Primary Examiner*—Danny Worrell
(74) *Attorney, Agent, or Firm*—Womble Carlyle Sandridge & Rice, PLLC

(57) ABSTRACT

A knitted fabric having moisture management properties. The fabric is formed from filamentary yarns and spun yarns, both the filamentary and spun yarns having substantially the same weight per unit of length. The fabric is knitted with so that the courses alternate between a filamentary yarn and a spun yarn.

39 Claims, 2 Drawing Sheets

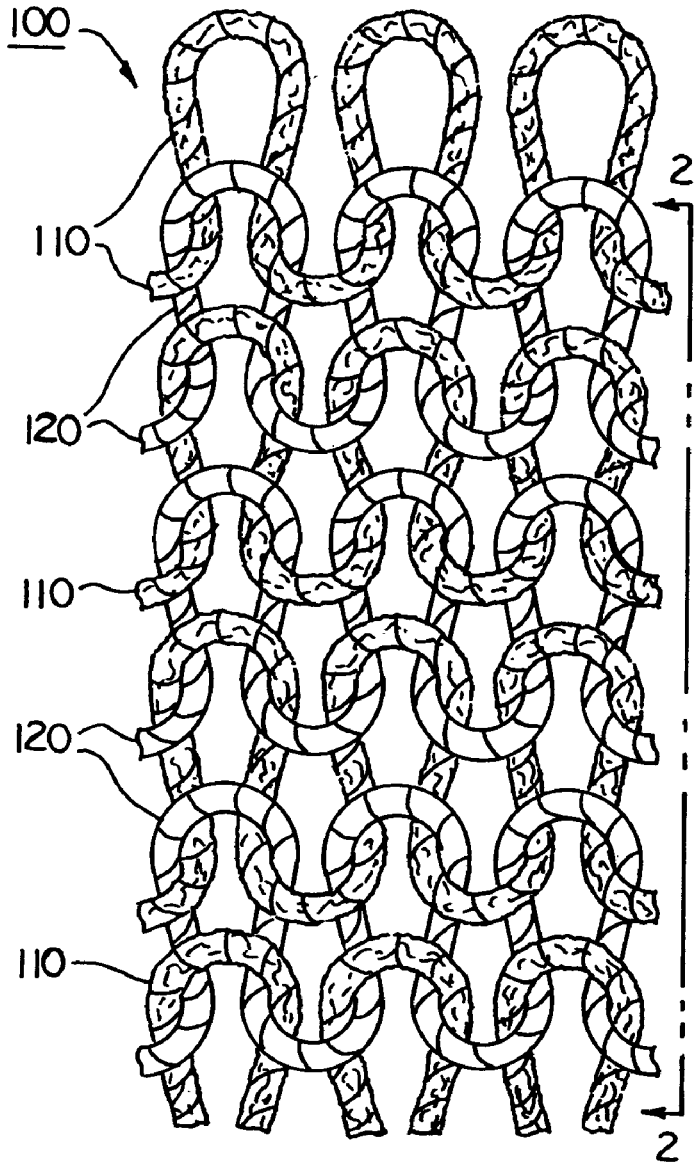
FIG. 1
FIG. 2
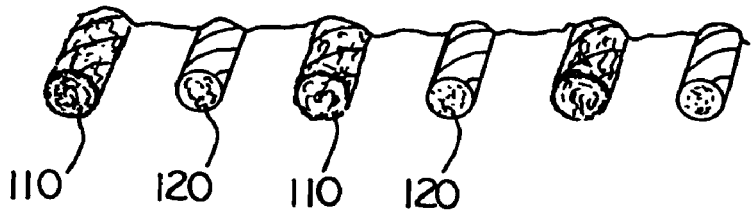

KNITTED FABRIC CONSTRUCTION WITH IMPROVED MOISTURE MANAGEMENT

FIELD OF THE INVENTION

The present invention relates to the field of textile production, and, more particularly to a knitted fabric construction, and apparel formed therefrom, having improved moisture management properties.

BACKGROUND OF THE INVENTION

Over the years, textile and apparel manufacturers have sought new fabric constructions, materials of construction, and conditioning or finishing techniques for improving the moisture absorbency or moisture control properties of apparel. Particularly with respect to outerwear, activewear, sportswear, and uniform garments, end users are most interested in the comfort and appearance of the apparel. Two of the most important factors related to comfort are moisture absorbency and hand, or softness.

Fabric constructions for sweat-absorbent textile fabrics that are suitable for outerwear and sportswear are well known in the art. One such construction comprises a multi-layer construction, which includes a water absorbent layer having high moisture absorbency and a water-permeable layer having high moisture permeability, but a lower moisture absorbency. Such a construction advantageously wicks moisture from one layer to another. Creating these multi-layer constructions, however, requires that the various layers be stitched or bonded together in a separate step. Such a multi-layer construction is not only more bulky, which is less desirable from a wearer's point of view, but it is also more expensive to construct.

Another known fabric construction for optimizing moisture management properties facilitates the movement of moisture from the inner layer of the fabric having larger voids to the outer layer of the fabric having smaller voids. The disadvantage of such a construction, however, is that additional conditioning or finishing steps result in a relatively more expensive finished fabric.

Another conventional sportswear construction includes a textile fabric having a cotton inner lining, which is hyrdrophilic. Thus, when the cotton comes in contact with the body of the wearer, it exhibits a high moisture absorbency. A disadvantage of cotton, however, is that it quickly becomes saturated and loses its shape. This has caused manufacturers to turn to polyester as a substitute for cotton. Conventional yarns of polyester, however, are generally hydrophobic and thus are not particularly suitable for the removal of moisture away from the wearer's skin.

SUMMARY OF THE INVENTION

One aspect of the present invention is directed to a knitted fabric, and apparel formed therefrom, having improved moisture management properties.

The knitted fabric is formed from filamentary yarns and spun yarns of similar synthetic materials. In one preferred embodiment, the synthetic material is a polymer of polyester. Desirably, the polyester filaments comprising the filamentary yarn and the polyester comprising the spun yarn have hydrophilic properties such as moisture channeling geometries for capturing, transporting, and releasing moisture. Although polyesters are conventionally hydrophobic, the channels formed in the filaments of these yarns have been found to be highly effective pathways for the movement of moisture from an undesirable location.

The fabric may be knitted on either a circular or flat knitting machine, so long as the filamentary and spun yarns are knitted side by side; i.e., one course consisting of only one filamentary yarn is following by one course consisting of only one spun yarn, and so on. The resulting fabric is a jersey knit construction comprising 50 percent, by number, filamentary yarns, and 50 percent, by number spun yarns, with a tolerance of about 5 percent, depending upon the number of feeds for the particular machine. Conventionally, "jersey" knit fabric is either a circular-knit or flat-knit fabric made with a plain stitch in which the loops intermesh in one direction only.

It has been found that the knitted fabric, and thus the apparel formed from the fabric, of the present invention provides excellent moisture management (wicking, moisture transport, and drying rate), which helps regulate the body temperature during high aerobic activity in warm weather. Several aspects of the knitted fabric construction produce these properties. First, the hydrophilic nature and geometries of the spun and filamentary yarns provide a high level of wicking, moisture transport, and drying. Second, by alternating the filamentary and spun yarns, with the spun yarns having an inherent "hairiness", the spun yarns are prevented from interlocking or appreciably entangling with one another. This creates an openness in the fabric, which promotes higher moisture transport. Third, channeling on the inside face of the fabric occurs due to the stiffness of the filaments versus the softness of the spun yarn. The channeling enhances moisture movement in the direction of the courses, which has been found to further increase the drying rate of the fabric. Further, the knitted fabric and apparel formed therefrom have been found to have higher strength (bursting strength greater than 140 pounds force) and less pilling than other jersey fabric constructions, when measured in accordance with the Random Pill Test.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

FIG. 1 is a perspective front view of the knitted fabric constructed in accordance with the present invention;

FIG. 2 is a sectional view of the knitted fabric of the present invention taken along Line 2—2 of FIG. 1;

DETAILED DESCRIPTION OF THE PREFERRED EMBODIMENTS

Figures 3, 4, 5:
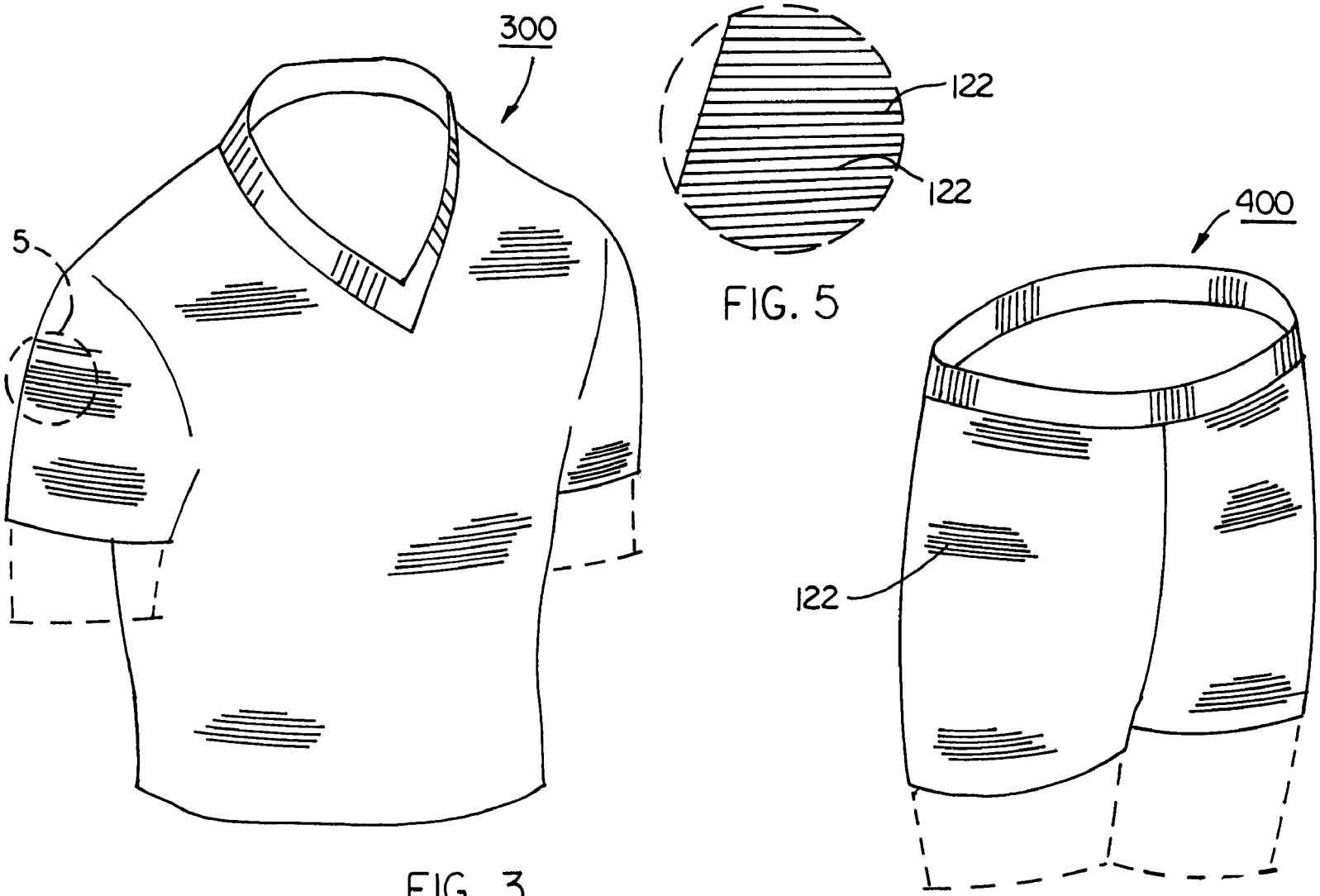
FIGS. 3 and 4 are perspective views of garments constructed from the knitted fabric of the present invention.
FIG. 5 is an enlarged view of the ribbed pattern in the garments formed from the knitted fabric of the present invention.

As shown in FIG. 1, one preferred embodiment of the present invention is directed to a knitted fabric having improved moisture management properties. As used herein, "moisture management properties" refers to such characteristics of a fabric or article of apparel as the wicking rate, moisture transport rate, and drying (or release) rate. As those skilled in the art will appreciate, "wicking" refers to capillary action in a fabric whereby moisture or liquid is dispersed or spread through a given area. "Moisture transport rate" means the distance traveled along the length of a fiber or filament within a prescribed time limit. "Drying rate" or "release rate" refer to the volume of water evaporated, or otherwise removed, from a fabric within a prescribed time limit.

Shown generally as 100 in FIG. 1, the knitted fabric comprises alternating courses of yarns 110 and 120. A sectional view of the alternating courses 110 and 120 is shown in FIG. 2. Yarns 110 are preferably ring spun yarns formed from a hydrophilic polymer of polyester. While polyester yarns are conventionally hydrophobic, are now yarns having geometries and chemical treatments that result in a polyester having hydrophilic properties. As those skilled in the art will appreciate, spun polyester yarns are formed from short staple fibers whereby the spinning process typically results in a yarn having a relatively softer hand than filamentary polyester yarns. One suitable ringspun hydrophilic polyester yarn is available under the trademark HYDROTEC™ from DAK Americas in Charlotte, N.C. HYDROTEC™ is a hydrophilic filamentary material having a channeling surface which provides bonding sites for water molecules to interact with the polymer surface of the filament, thus wetting the filament.

In one preferred embodiment, the spun yarn is a 24/1 yarn; however, it has been found that a spun yarn sized between about 8/1 and 40/1 will provide a fabric that achieves the desired moisture management properties.

As is known, filamentary polyester yarns are relatively more hydrophilic than spun polyester staples. One suitable filamentary yarn is available under the tradename SORBTEK™, available from Unifi, Inc. of Greensboro, N.C. SORBTEK™ also has a moisture channeling geometry designed to capture, transport, and release moisture faster than conventional wicking yarns. While the use of HYDROTEC™ and SORBTEK™ yarns are described in particular detail herein, the present invention is not limited thereto; rather, there are other known wicking filaments and yarns that have unique cross-sections wherein one or more channel shapes (semi-circular, oval, etc.) are formed along the length of the filaments for transporting moisture away from an undesired location in the fabric. In the preferred embodiment discussed above, the filamentary yarn is sized as 1/250/100; however, it has been found that filamentary yarns sized between about 100 denier and 300 denier will yield a fabric that achieves the desired moisture management properties when knitted with the ringspun yarn described above. To enhance the attraction of water into the channels, a hydrophilic surface treatment with an affinity for polyester may optionally be applied.

The knitted fabric may be formed on either a circular knitting machine or a flat knitting machine to obtain a fabric having a knitted weight of between about 3.5 and 8 ounces per square yard. The following is one example of the knitting specifications and setup parameters for one preferred embodiment of the knitted fabric construction formed on a circular knitting machine. This example fabric construction is but one of numerous knitted fabric constructions that can be formed in accordance with the present invention.

EXAMPLE

A jersey fabric was knitted on a Monarch circular knitting machine, available from Monarch Knitting Machine Corporation of Monroe, N.C. The machine is set up with a 22 inch knitting head and knits at 40 rpm. The yarn feeds are end over end and comprise a 24/1 HYDROTEC™ yarn, and a 1/250/100 SORBTEK™ yarn. The top and bottom tape settings are set at 200 inches per revolution, with a yarn tension of 6–8 grams, and a quality wheel setting of 149. The final knitted fabric weight is about 4.32 ounces per square yard, with 37 stitches per inch and a wale count of 26.5.

It has been found that alternating courses of spun and filamentary polyester yarns provides several desirable properties in the completed fabric. In particular, heretofore unexpected results are obtained when the spun yarns and filamentary yarns have approximately the same weights per unit of length. As best illustrated in the exploded view of FIG. 2, if the core diameters of the spun 110 and filamentary 120 yarns are approximately the same, the staple fibers of the spun yarns that protrude, creating a "hairy' effect, are effectively prevented from interlocking with one another. If the hairs of the spun yarns do interlock, a relatively closed knitted structure results, which inhibits moisture transport. Separating the interspersing spun yarns between the filamentary yarns tends to open up the fabric structure, creating voids that promote moisture transport. Additionally, because the filamentary yarns are relatively stiff as compared to the ringspun yarns, a channel is created along the filaments and between the filamentary yarns and the spun yarns. The channels also promote moisture movement. This in turn increases the release, or drying rate of the fabric. Additionally, the channels created by alternating the spun and filamentary yarns provide a striped appearance and aesthetic appeal for the fabric and apparel formed therefrom.

It has been found through testing by the inventors that the fabric of the present invention provides moisture management properties surpassing those of other jersey knit constructions. For example, testing has shown that, among other constructions, the fabric of the present invention exceeds the moisture management performance of 100 percent ringspun or 100 percent filamentary polyester jersey knits, which are conventional. The following table illustrates the results of some of the testing performed on the knitted fabric of the present invention.

| | Time To Which Water Rises to 1 Inch | |
|---|---|---|
| | Original State | After 5 Washings |
| Length | 28 Seconds | 21 Seconds |
| Width | 32 Seconds | 30 Seconds |

This table represents exemplary test results for the Liquid Wicking Rate of the knitted fabric when tested in accordance with a simple test procedure. A fabric sample is first maintained in an atmosphere of about 70 degrees Fahrenheit and about 65 percent humidity for at least about 4 hours. The sample is then cut into strips about 1 inch wide and several inches long. At least 3 strips are individually hung vertically along their long dimensions. The lower ends of the strips are immersed approximately ⅛ inch in a colored water. The time is then recorded for the water to rise 1 inch in each strip. The results for at least three strips are averaged to obtain a liquid wicking rate for the fabric sample. As shown in the table, the knitted fabric in its original completed state, i.e., unwashed, will wick water to a height of one inch in about 28 seconds in the length direction and 32 seconds in the width direction of the fabric. It has also been found that when subjected to 5 launderings, water will wick to one inch in about 21 seconds in the length direction and about 30 seconds in the width direction. For purposes of testing, a laundering is defined as Machine Wash Warm (105° F.+/−5° F.), Tumble Dry Low.

The knitted fabric of the present invention was also tested for its Water Vapor Transmission Rate and Water Vapor Permeance in accordance with American Society of Testing and Materials Standard E96-00e1, Standard Test Methods for Water Vapor Transmission of Materials, incorporated by reference herein in its entirety. Water Vapor Transmission Rate is defined as the steady water vapor flow in unit time through unit area of a body, normal to specific parallel surfaces, under specific conditions of temperature and humidity at each surface. Water Vapor Permeance is defined as the time rate of water vapor transmission through unit area of flat material or construction induced by unit vapor pressure difference between two specific surfaces, under specified temperature and humidity conditions. The Water Vapor Transmission Rate for the knitted fabric of the present invention in its original state averaged 854 for a test set of three samples. Water Vapor Permeance for the knitted fabric in its original state averaged 7.03E-06 for a test set of three samples.

Turning now to FIGS. 3 and 4, examples of apparel that may be formed from the knitted fabric of the present invention are shown. FIG. 3 is illustrative of underwear 300, such as T-shirts, outerwear, or activewear. Ribs 122, shown best in FIG. 5, are formed by the stiffer filamentary yarns 120 and the channeling effect created by alternating courses of spun and filamentary polyester yarns. Similarly, FIG. 4 is illustrative of underwear 400 or activewear, with ribs 122 shown for illustration only.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A knitted fabric having improved moisture management properties, comprising:

(a) a plurality of filamentary yarns (b) a plurality of spun yarns;

(c) wherein the filamentary and spun yarns have substantially the same weight per unit of length, at least some of the filamentary and spun yarns are synthetic, and at least some of the synthetic yarns are hydrophilic; and (d) wherein the courses of the knitted fabric alternate between a filamentary yarn and a spun yarn.

2. The knitted fabric of claim 1 wherein the filamentary yarn is substantially polyester.

3. The knitted fabric of claim 2 wherein the polyester yarn is a multi-filament yarn, each filament having a channel for moving moisture along the length of the yarn.

4. The knitted fabric of claim 1 wherein the spun yarn is substantially polyester.

5. The knitted fabric of claim 4 wherein the yarn is a ring spun yarn.

6. The knitted fabric of claim 1 wherein each of the filamentary yarn and the spun yarn are between about 100 denier and 300 denier.

7. The knitted fabric of claim 1 wherein the alternating spun yarns are not substantially interlocked.

8. The knitted fabric of claim 1 wherein the fabric is weft knitted.

9. The knitted fabric of claim 8 wherein the fabric is circular knitted.

10. The knitted fabric of claim 1 wherein the fabric is a jersey knit.

11. The knitted fabric of claim 1 wherein the knitted fabric has a weight of between about 3.5 and 8 ounces per square yard.

12. The knitted fabric of claim 1 wherein water will wick in unlaundered knitted fabric to a height of about 1 inch in less than about 30 seconds in the length direction and less than about 34 seconds in the width direction.

13. The knitted fabric of claim 1 wherein water will wick in the knitted fabric to a height of about 1 inch in less than about 24 seconds in the length direction and less than about 32 seconds in the width direction, after 5 home launderings.

14. The knitted fabric of claim 1 wherein the knitted fabric will shrink less than about 6 percent when subjected to 3 home launderings.

15. An article of apparel formed from a knitted fabric having improved wicking, the knitted fabric comprising:

(a) a plurality of filamentary yarns (b) a plurality of spun yarns;

(c) wherein the filamentary and spun yarns have substantially the same weight per unit of length, at least some of the filamentary and spun yarns are synthetic, and at least some of the synthetic yarns are hydrophilic; and (d) wherein the courses of the knitted fabric alternate between a filamentary yarn and a spun yarn.

16. The article of apparel of claim 15 wherein the filamentary yarn is substantially polyester.

17. The article of apparel of claim 16 wherein the polyester yarn is a multi-filament yarn, each filament having a channel for moving moisture along the length of the yarn.

18. The article of apparel of claim 15 wherein the spun yarn is substantially polyester.

19. The article of apparel of claim 18 wherein the yarn is a ring spun yarn.

20. The article of apparel of claim 15 wherein each of the filamentary yarn and the spun yarn are between about 100 denier and 300 denier.

21. The article of apparel of claim 15 wherein the alternating spun yarns are not substantially interlocked.

22. The article of apparel of claim 15 wherein the fabric is weft knitted.

23. The article of apparel of claim 22 wherein the fabric is circular knitted.

24. The article of apparel of claim 15 wherein the fabric is a jersey knit.

25. The article of apparel of claim 15 wherein the knitted fabric has a weight of between about 3.5 and 8 ounces per square yard.

26. The article of apparel of claim 15 wherein water will wick in unlaundered knitted fabric to a height of about 1 inch in less than about 30 seconds in the length direction and less than about 34 seconds in the width direction.

27. The article of apparel of claim 15 wherein water will wick in the knitted fabric to a height of about 1 inch in less than about 24 seconds in the length direction and less than about 32 seconds in the width direction, after 5 home launderings.

28. The article of apparel of claim 15 wherein the knitted fabric will shrink less than about 6 percent when subjected to 3 home launderings.

29. A method for forming a knitted fabric having improved moisture management properties, comprising the step of:

selecting filamentary and spun yarns having substantially the same weight per unit of length, wherein at least some of the filamentary and spun yarns are synthetic, and at least some of the synthetic yarns are hydrophilic; and knitting alternating courses of the filamentary and spun yarns.

30. The method of claim 29 wherein the filamentary yarn is substantially polyester.

31. The method of claim 29 wherein the polyester yarn is a multi-filament yarn, each filament having a channel for moving moisture along the length of the yarn.

32. The method of claim 29 wherein the spun yarn is substantially polyester.

33. The method of claim 29 wherein the yarn is a ring spun yarn.

34. The method of claim 29 wherein each of the filamentary yarn and the spun yarn are between about 100 denier and 300 denier.

35. The method of claim 29 wherein the alternating spun yarns are not substantially interlocked.

36. The method of claim 29 wherein the fabric is weft knitted.

37. The method of claim 36 wherein the fabric is circular knitted.

38. The method of claim 29 wherein the fabric is a jersey knit.

39. The method of claim 29 wherein the knitted fabric has a weight of between about 3.5 and 8 ounces per square yard.

* * * * *